US005228173A

United States Patent [19]

Egerer

[11] Patent Number: 5,228,173

[45] Date of Patent: Jul. 20, 1993

[54] METHOD FOR CLEANING A NEEDLE BAR, IN PARTICULAR A TOP COMB FOR TEXTILE MACHINERY, AND NEEDLE BARS FOR PUTTING THE METHOD INTO PRACTICE

[75] Inventor: Josef Egerer, Schwabach, Fed. Rep. of Germany

[73] Assignee: Staedtler & Uhl, Schwabach, Fed. Rep. of Germany

[21] Appl. No.: 943,825

[22] Filed: Sep. 14, 1992

[30] Foreign Application Priority Data

Sep. 13, 1991 [DE] Fed. Rep. of Germany ..... 4130496

[51] Int. Cl.[5] ..... D01G 19/22

[52] U.S. Cl. ..... 19/218; 19/129 R

[58] Field of Search ..... 19/129 R, 218

[56] References Cited

U.S. PATENT DOCUMENTS 2,927,347 3/1960 Köhler ..... 19/129 R
2,977,642 4/1961 Edfors ..... 19/218
4,928,356 5/1990 Egerer .
5,054,167 10/1991 Egerer ..... 19/218

FOREIGN PATENT DOCUMENTS 2942588 11/1980 Fed. Rep. of Germany .

*Primary Examiner*—Clifford D. Crowder
*Assistant Examiner*—John J. Calvert
*Attorney, Agent, or Firm*—Browdy and Neimark

[57] ABSTRACT

In a method for cleaning the needle bar, in particular a top comb for textile machinery, comprising at least one row of needles or needle-like stamped elements, which are held between two cover plates, whereby the needle tips protrude, while forming free passageways, by a certain amount between those free passageways beyond the lower edge of the cover plates, and whereby compressed air is guided through the free passageways, it is provided, in order to attain an optimum guidance of the fiber band and a complete combing, that depending on the working cycle of the machine, into which the needle bar is inserted, the free passageways between the needles, respectively the region before the needles are alternately activated with overpressure or underpressure. A needle strip according to the invention which is particularly suitable for putting the method into practice, is formed of needle-like stamped elements, which comprise asymetrical lateral projections, and which are lined up in such manner that the projections are directed towards the one or the other side in alternating manner, so that air channels are formed between the projections.

4 Claims, 2 Drawing Sheets

METHOD FOR CLEANING A NEEDLE BAR, IN PARTICULAR A TOP COMB FOR TEXTILE MACHINERY, AND NEEDLE BARS FOR PUTTING THE METHOD INTO PRACTICE

FIELD OF THE INVENTION

The invention relates to a method for cleaning a needle bar, in particular a top comb for textile machinery, comprising at least one row of needles, which are held between two cover plates, whereby the needle tips protrude, while forming free passageways, by a certain amount between those free passageways beyond the inner edge of the cover plates, and whereby compressed air is guided through the free passageways, as well as to a needle bar for putting the method into practice.

BACKGROUND OF THE INVENTION

A method of this type and a corresponding needle bar are known from DE 37 22 481 B1. Herein it is already described that is possible to work with overpressure or underpressure for producing a cleaning air-flow. The measures described in the generic patent specification aim exclusively to replace the previously mechanically executed cleaning of the cleaning comb, e.g. by means of cleaning blades, as they are approximately known from DE 29 42 588 A1, by a cleaning by means of an airflow, which mechanically treats the needles with care, and which is also feasible in case of narrow spacial conditions.

SUMMARY OF THE INVENTION

With the above considerations in mind it is an object of the invention to improve a method of this type by a defined control of the direction of the airflow, while utilizing the pressure or suction means, which are anyway available for the production of an airflow, in such manner that not only a reliable cleaning is achieved, but also the guidance of the fiber band is optimized.

This object is attained in accordance with the invention by the fact that, depending on the working cycle of the machine, into which the needle bar is inserted, the free passageways between the needles, respectively the region before the needles are alternately activated with overpressure or underpressure.

In particular it is provided advantageously that in case the needle bar is embodied as a top comb, which is arranged behind a nippers assembly, an underpressure is applied in the phase of closing the nippers assembly until the closed condition is achieved, in order to hold the fibers at the top comb, and that only after closure of the nippers compressed air is applied for cleaning.

The underpressure holds the fibers, which are drawn off from the nippers by the draw-off rollers, in the spaces of the needles in the direct line of draw-off. By this way it is avoided that the fibers take the easier way after the fiber band located in the nippers is released and that they are drawn away from underneath the tips of the top comb in uncleaned manner into the draw-off rollers. Due to the underpressure or the suction current the back ends of the fibers can be lifted during tearing-off, which back ends have left the nippers. As a result they do no more sag downwards. It is assured accordingly that combing is performed by the top comb.

According to the invention the available air channels are also utilized to improve the fiber guidance by means of the top comb. Furthermore, by means of alternately applying underpressure and overpressure and by the changing direction, resulting on this occasion, of the airflow through the top comb, it is achieved that the deposit of impurities is substantially avoided.

Further details will become apparent from the ensuing description of one prefered example of embodiment taken in conjunction with the drawing.

DESCRIPTION OF THE PREFERRED EMBODIMENTS

Figure 1:
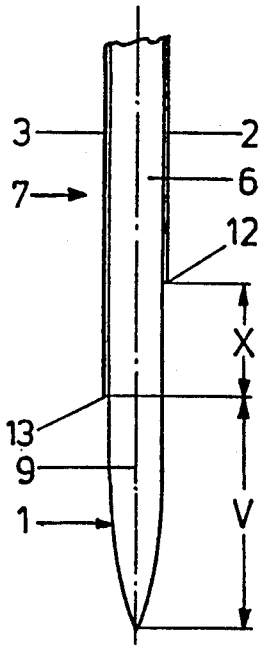
FIG. 1 shows a cross-section parallel to the longitudinal direction of the needles through a needle bar, with which the method according to the invention can be put into practice.
Figure 2:
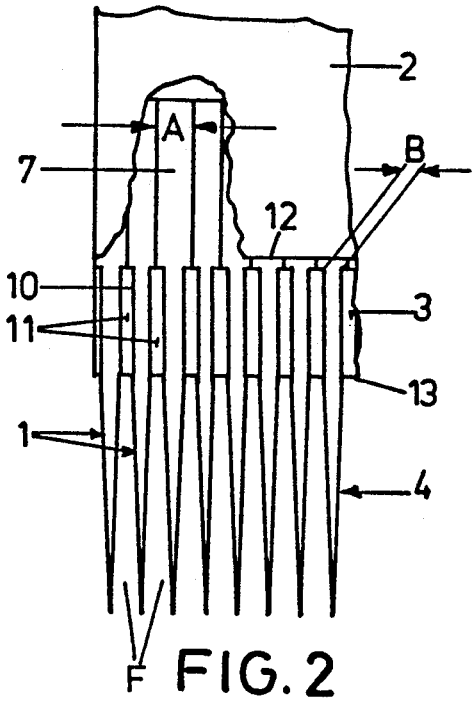
FIG. 2 shows a side view on a needle bar according to FIG. 1 in an illustration which is partially broken away.

A needle bar shown in FIGS. 1 and 2, which is used as a top comb, comprises a row of needles 1, which are arranged between a first cover plate 2 and a second cover plate 3. The needles 1 can be interconnected by adhesion or by soldering. The cover plates 2 and 3 are provided in particular in case of adhesion of the needles 1.

A tip area 4 is formed by means of the fact that based on a point 5 the needles 1 are stamped while reducing their original thickness. The remaining portion is called shank 6. The shank region 7 is substantially covered by the cover plates 2, 3 in case of conventional needle combs.

There are free passageway F between the needles 1, which are determined by the ratio of the thickness of the stamped tip area 4 and of the nonworked shank 6. The width of the shank 6 determines how many needles 1 are provided per length unit of the needle bar, as the shanks 6 lie close together.

The length of the projecting needle tips 4 is called protrusion V.

In an embodiment of the generic type of such a needle bar, which is known per se from DE 37 22 418 B1, it is provided that the first cover plate 2 is embodied in a shorter manner compared with the second cover plate 3 viewed in direction of the longitudinal axis of the needle 9, and that by an amount, which is larger than an additional stamp portion 10 of the needles 1, which has the length X. By means of this additional stamp portion 10 air channels 11 are formed between the needles 1, which air channels 11 extend from the lower edge 12 of the first, shorter cover plate 2 to the lower edge 13 of the second, longer cover plate 3 and terminate in the free passageway F between each of two adjacent needles 1.

Due to the stamps 10 the needles 1 have a reduced width B in this region compared with a width A in the region of the shank 7.

Figure 3:
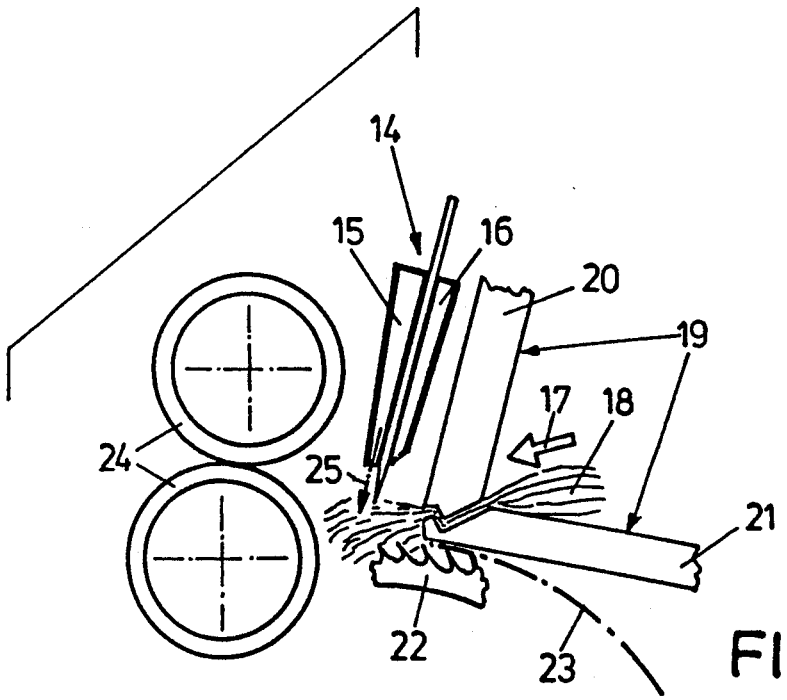
FIG. 3 shows a section illustrating the arrangement of a top comb with an alternative embodiment of the air guidance at a cotton combing machine.

For the feeding of compressed air several possibilities are described in DE 37 22 481 B1. In like manner also an underpressure can be applied via the corresponding provided channels. The top comb 14 shown in FIG. 3 comprises for example air guiding chambers 15 and 16.

The top comb 14 is arranged in transport direction (arrow 17) of the fiber band 18 behind a nippers assembly 19, which consists of a nipper knife 20 and of a lower half of the nippers 21 with a drive, which is not shown in detail. The nippers assembly 19 opens and closes at fixed cycles depending on the rotation of a combing segment 22 of a combing cylinder 23 only outlined in its periphery in such manner, that when passing the combing segment 22, the fiber band 18 is held between the nipper knife 20 and the lower half of the nippers 21, so that the fibers can be combined, and that the nippers assembly 19 opens in the subsequent phase, so that the combed portion of the fiber band can be drawn off by two draw-off rollers 24, which follow in transport direction (arrow 17).

In timed coordination with the opening and closing of the nippers assembly 19 compressed air is applied via the air chambers 15, 16, which compressed air escapes in direction of the arrow 25, and which blows away impurities of the region of the protrusion of the needle V or an underpressure is applied, which produces an airflow in opposite direction to the arrow 25, by means of which the fibers of the fiber band 18 are guided in the region of the protrusion of the needle V of the top comb 14. This means that the overpressure is applied, if the nippers assembly 19 is closed, in order to remove the impurities, which have remained at the top comb 16 during the preceding combing process.

Figure 4:
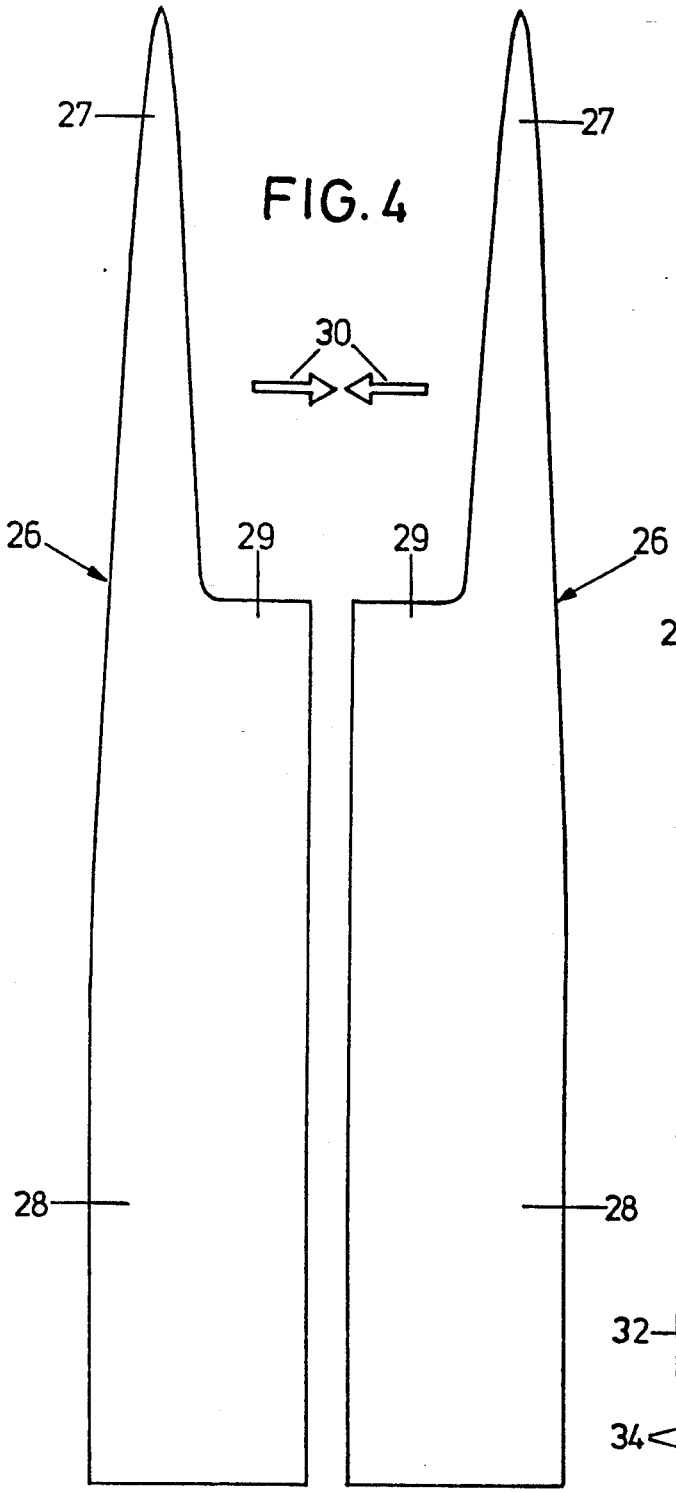
FIG. 4 shows two needle-like stamped elements for forming a needle bar according to the invention.
Figure 6:
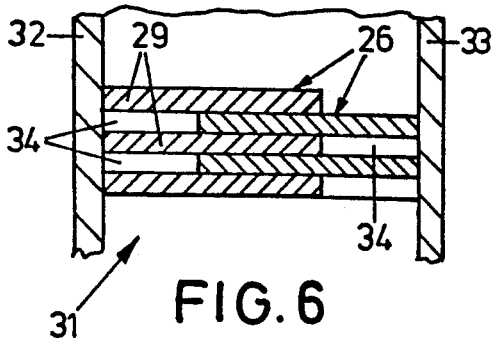
FIG. 6 shows a section through a needle bar according to the invention formed by stamped elements shown in FIGS. 4 and 5.

In FIGS. 4 and 6 it shown how a needle bar, for putting the method according to the invention into practice, can be embodied in a particularly prefered manner. A needle bar of this type consists of a plurality of needle-liked stamped elements 26 with a tip 27 and a foot 28. The foot 28 comprises a lateral projection 29 below the tip area, so that the entire needle-like stamped element 26 becomes asymmetrical. The projection 29 can have approximately the width of the needle foot 28.

Figure 5:
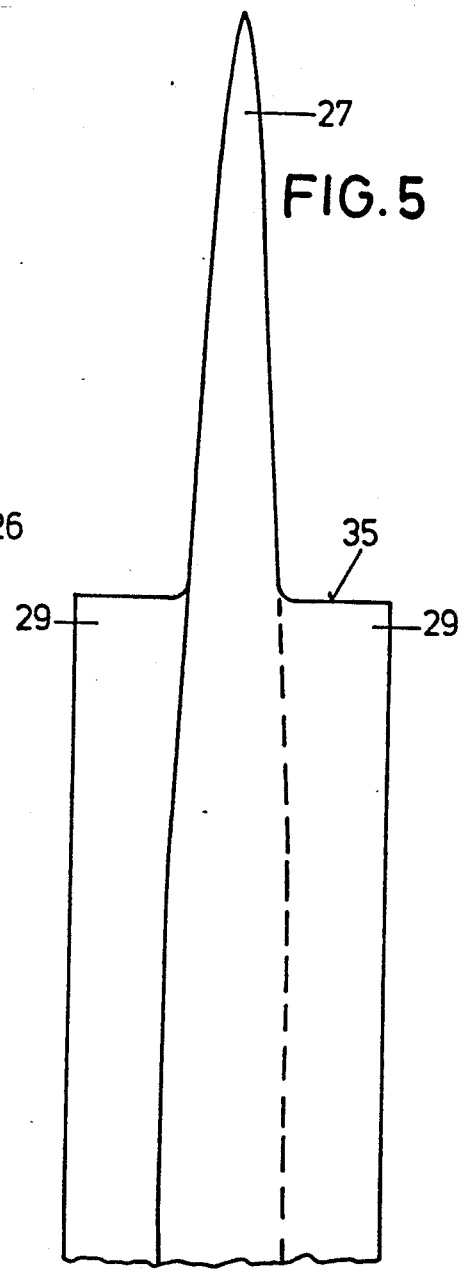
FIG. 5 shows a view of the stamped elements according to FIG. 4 in the lined-up condition.

In FIG. 4 two stamped elements 26 of this type are rotated by 180° in relation to each other. These stamped elements 26 can be lined up by pushing them together in direction of the arrows 30 in such manner as is shown in FIG. 5, i.e. that the needle tips 27 are placed in congruent manner one behind the other, whereas the projections 29, viewed in the direction of the lined-up needle bar 31, successively protrude to the left or to the right in alternating manner, as can be seen in the section according to FIG. 6. By means of this, air guiding channels 34 are formed in each case between two successive projections 29, which each protrude to the same side, and the basic body of the stamped element, which is located therebetween, of the stamped element 26 extending in the other direction, and the respective cover plate 32 or 33, which air guiding channels 34 terminate in the region of the upper front edges 35 of the projections 29, i.e. in the region of the tips 27, and which form on the whole a relatively large cross-section for applying an underpressure or overpressure, so that the pressure conditions in the tip area and accordingly the strength and the direction of the airflow prevailing there can be adjusted very effectively and with the necessary capacity.

What is claimed is:

1. A method for cleaning a needle bar in the form of a top comb for textile machinery, said needle bar having at least one row of needle-like elements, which are held between two cover plates, wherein needle tips of said of at least one row of needle-like elements protrude while forming free passageways by a certain amount between said free passageways, and wherein said top comb is arranged down stream in a material flow direction of a nippers assembly, said method comprising the steps of;

applying an underpressure to said top comb in a phase of closing said nippers assembly until a closed condition is achieved in order to hold fibers being combed at the top comb and applying compressed air only after closure of said nippers.

2. A needle bar for use as a top comb for textile machinery, said needle bar being easily cleaned by application of an underpressure and compressed air, said needle bar comprising:

at least one row of needle-like elements, which are held between two cover plates, wherein needle tips of said at least one row of needle-like elements protrude while forming free passageways by a given amount between said free passageways, and wherein said top comb is arranged downstream in a material flow direction of a nippers assembly, wherein each needle-like element of said at least one row of needle-like elements (26), comprises a lateral projection (29) in the foot region, said at least one row of needle-like elements 26 being lined up in such manner, that said needle tips (27) are in congruence and that said projections (29) protrude to one or the other side in alternating manner, so that air channels (34) are formed between said projections (29) adjacent on the same side respectively.

3. The needle bar according to claim 2, wherein said each needle-like element is formed asymmetrical in such a manner that said each needle-like element comprises, a lateral projection (29) in the foot region.

4. The needle bar according to claim 2, wherein said each needle-like element is formed by stamping.

* * * * *